United States Patent [19]

Hodgdon

[11] Patent Number: 5,005,598

[45] Date of Patent: Apr. 9, 1991

[54] PAINT ROLLER RINSER

[76] Inventor: Ronald E. Hodgdon, 3521 Timber La., Anderson, Calif. 96007

[21] Appl. No.: 569,210

[22] Filed: Aug. 16, 1990

[51] Int. Cl.[5] ..... B08B 3/02

[52] U.S. Cl. ..... 134/138; 134/900

[58] Field of Search ..... 134/900, 138, 149; 68/213

[56] References Cited

U.S. PATENT DOCUMENTS

| | | | |
|---|---|---|---|
| 3,688,785 | 9/1972 | Stevens et al. | 134/138 |
| 4,130,124 | 12/1978 | Sherwin | 134/138 |
| 4,641,673 | 2/1987 | Conley et al. | 134/138 |
| 4,672,987 | 6/1987 | Brandt | 134/138 |
| 4,832,066 | 5/1989 | Shipman | 134/138 X |

FOREIGN PATENT DOCUMENTS

| | | | |
|---|---|---|---|
| 2360884 | 6/1975 | Fed. Rep. of Germany | 134/138 |

*Primary Examiner*—Philip R. Coe

[57] ABSTRACT

An elongated tubular housing enclosed on both open ends with housing end walls, and lengthwise horizontally disposed in use. Each housing end wall contains a small fluid discharge opening for elimination of fluid and paint residue. A living hinge attached door over an opening is provided in the housing to allow installation of a paint roller brush. A pressurized fluid receiving and fluid distribution system within the housing is affixed with a plurality aimed fluid emission nozzles which can be manually repositioned to rotate a roller brush first in one direction then another direction for improved cleaning. A removable rigid member extending perpendicular to the housing serves as a support brace which prevents rolling of the housing during use. The surface of the rigid member is affixed with a spring clip for securing the handle portion of a paint roller. Two transverse notches in the side wall of the housing serve to support the support rod section of a paint roller in combination with the spring clip in either one or the other of two paint roller holding positions.

4 Claims, 8 Drawing Sheets

PAINT ROLLER RINSER

BACKGROUND OF THE INVENTION

1. Field of the Invention:

This invention relates to apparatuses for rinsing paint from the brushes of paint rollers. The paint roller rinser of this disclosure is attachable to a pressured cleaning fluid source such as a garden water hose, and is specifically structured to accommodate the two most common varieties of paint rollers currently in wide use in the United States. The invention provides two separate roller holding positions in a single elongated horizontally oriented housing, and also allows spinning of roller brushes in two different directions for improved cleaning.

2. Description of the Prior Art:

Paint rollers, by their nature, are absorbent and retain a large amount of paint residue within the nap of the roller brush, even when apparently clean. Clean-up generally includes the user holding and scrubbing the roller under a running faucet until the water runs clear. This is not only messy but very time consuming. Several past art cleaning devices have been developed in an attempt to solve this problem. While these devices vary in their degree of effectiveness, they all possess drawbacks or disadvantages which have limited their popularity with the American consumer, as evidenced by the wide spread absence of these devices on the open market.

Herein disclosed are several past art paint roller cleaning devices for cleaning the rollers while attached to the support handles. These past art devices were examined in a search conducted at the U.S. Patent and Trademark Office, and of those patents examined, the following were considered most relevant to my device:

Stevens et al, was issued U.S. Pat. No. 3,688,785, on Sept. 5, 1972, for a double paint roller cleaner comprised of a cylindrical metal housing having a series of spraying apertures affixed to a water discharge outlet. The spraying apertures are designed to direct a narrow stream of high pressure water onto the paint roller in such a manner as to cause rotation and centrifugal action which ejects paint from the roller. The water and paint residue is eliminated out the base of the housing.

On June 16, 1987, Brandt was granted U.S. Pat. No. 4,672,987, for a plastic single roller paint cleaner similar to the device described in the Stevens et al patent.

Shipman was issued U.S. Pat. No. 4,832,066, on May 23, 1989, for a hydro centrifugal paint roller cleaning aid, also similar in structure to the two previous past art devices.

Conley was granted U.S. Pat. No. 4,641,673, on Feb. 10, 1987, for a cleaning device also similar in structure to the previously mentioned past art devices which is designed for both paint rollers and paint brushes and contains dual spraying apparatuses.

SUMMARY OF THE INVENTION

My paint roller cleaning apparatus is provided having a closed ended tubular transparent housing with an elongated opening and closable door sized for insertion of a single roller brush portion of a paint roller. The elongated housing of my invention is structured to be horizontally disposed lengthwise against a surface during use, providing improved stability. My paint roller cleaning apparatus is adapted with two holding structures for retaining the two most popular different types of paint rollers, one roller brush at a time. The interior of the housing is affixed with tubing and fluid distributing nozzles which aim and disburse a pressurized stream of fluid against the roller brush, causing rotation and ejection of the fluid and paint residue from the nap of the roller brush. In a slight variation of the invention, an adjustment knob affixed adjacent the exterior of one closed end of the housing allows manual repositioning of the angle of the disbursed fluid from the nozzles, thus reversing the rotation of the roller brush. The reversing of the direction of the rotation provides a more efficient and thorough method of cleaning when the roller brush is rotated first in one direction, and then in the reverse direction.

An interior fluid distribution tubing of the housing can be releasably affixed on the exterior of the housing to a rigid elongated tubular member, or fluid feed extension conduit, which is releasably connected to a conventional garden hose. This rigid extension conduit serves as a support surface for the handle of the paint roller and also serves as a brace to prevent the housing from rolling on a surface when in use. Fluid discharge openings are incorporated into each end of the housing for elimination of the fluid and paint residue.

My paint roller cleaning apparatus is unique from other roller cleaning devices in that it is completely stabilized and cannot fall over on its side, unlike the other past art cleaning devices. This stability is provided by the extension conduit placed perpendicular to the housing, along with the housing intended for use horizontally disposed on a surface. This structuring and use orientation eliminates the need of the user to manually hold or otherwise brace the device during use.

My invention is also relatively inexpensive to manufacture and assemble, which helps to maintain a relatively low market price.

Therefore, a primary object of my invention is to provide a paint roller cleaning apparatus which forcefully projects pressurized streams of water directly onto the roller brush, causing rotation and creating a centrifugal effect whereby the excess water and paint residue is ejected from the roller brush.

A further object of the invention is to provide the above in a paint roller cleaning apparatus which has two different roller holding and cleaning positions to allow cleaning of the two most popular structures of paint rollers in use in the U.S. today.

An even further object of the invention is to provide the above in a paint roller cleaning apparatus which allows visual observation of the cleaning process while in progress.

A still further object of the invention is to provide the above in a paint roller cleaning apparatus which is extremely stable and cannot be forced to fall over from the recoil of the back pressure of the hose or spraying nozzles.

Another object of the invention is to provide the above in a paint roller cleaning apparatus having nozzles which can be repositioned to redirect the angle of the fluid disbursed, thus reversing the rotational direction of the roller brush for improved cleaning.

Another object of the invention is to provide a paint roller cleaning apparatus which disassembles into a compact unit for easy transportation, shipping and storage.

Other objects and advantages will be best understood by reading the following description, with reference made to the accompanying drawings.

DESCRIPTION OF THE PREFERRED EMBODIMENTS

Figure 1B:
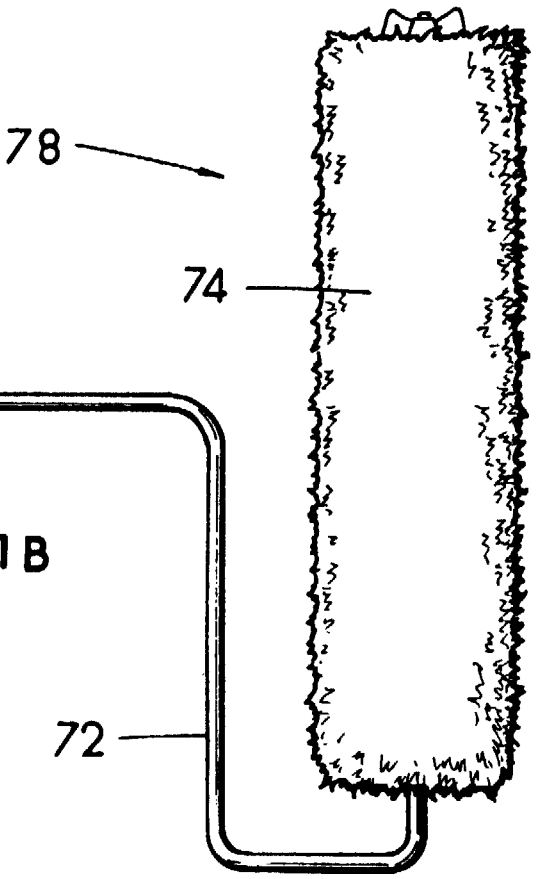
FIG. 1B is a top plan view of a paint roller having what I consider to be a straight support rod between the handle and the roller.

Referring now to the drawing FIGS. 1 through 7 where my paint roller cleaning apparatus is generally designated by the number 10. Two slightly varied versions of the present invention are comprised of two major part component groups. The first group being an elongated tubular housing 12 with two annular caps forming end closures of housing 12, referred to as first end wall 14 and second end wall 16. The second major part component group comprises a three member water distribution system comprised of fluid distributor 18 with connecting fluid feed conduit 20 and fluid feed extension conduit 22.

Figure 5:
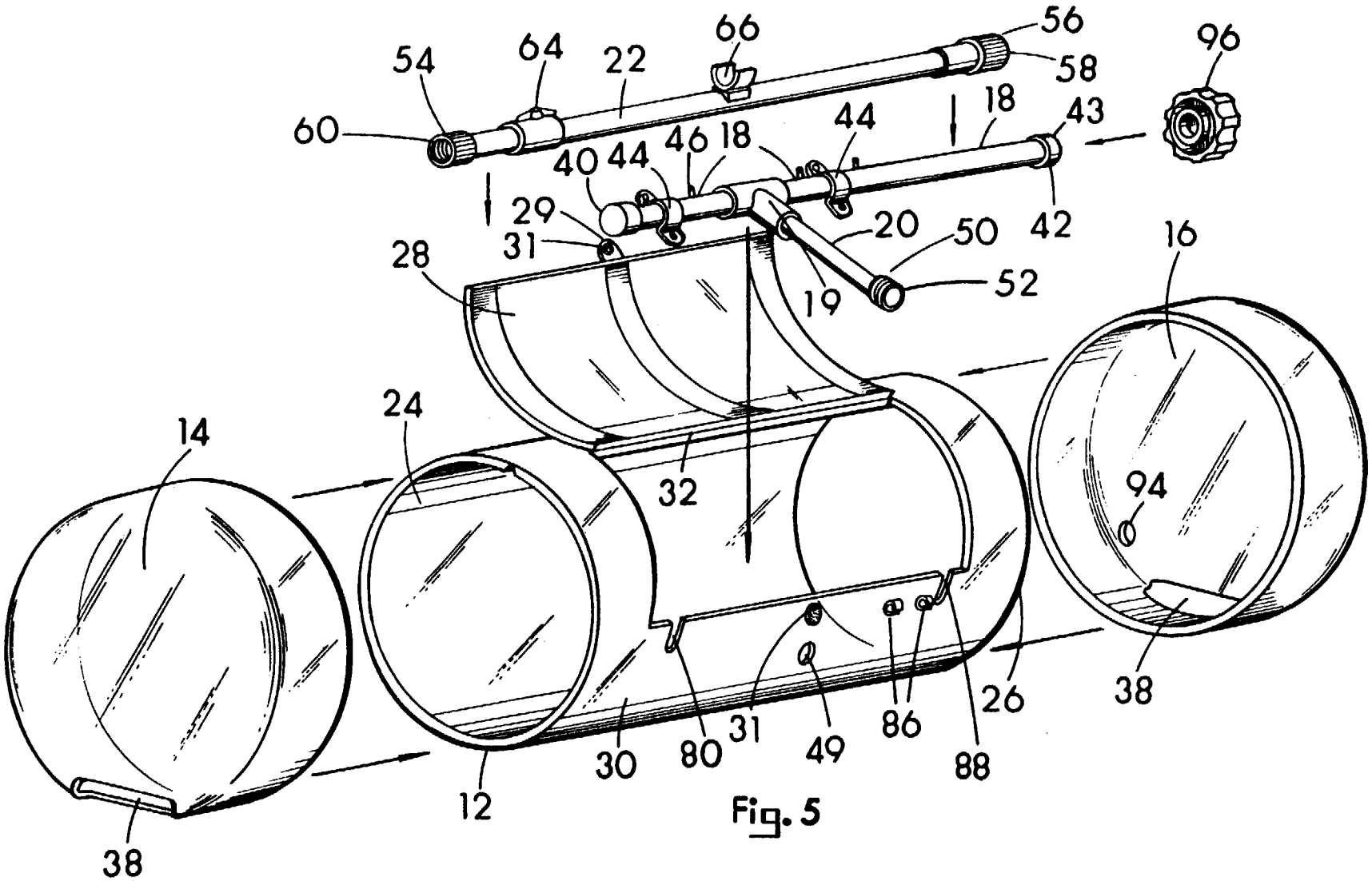
FIG. 5 is an exploded perspective view of the major components of the version of the invention having the spray redirecting structure. The fluid feed extension conduit is shown detached and positioned above the fluid distributor, illustrating that the fluid feed extension conduit can be stored inside the tubular housing. The fluid distributor is shown modified in this view, being extended, with the adjustment knob positioned on the right.
Figure 6:
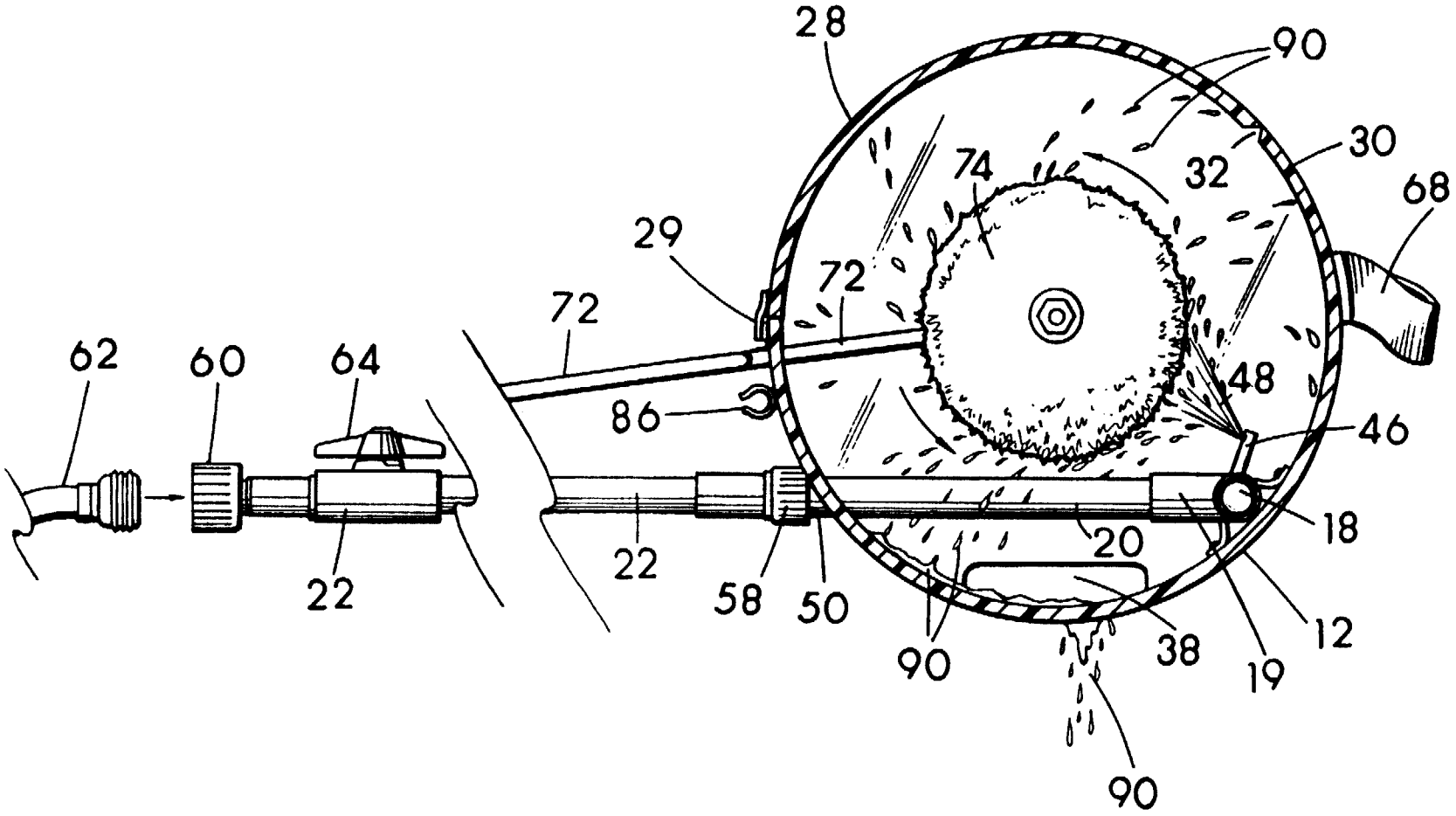
FIG. 6 is a partial cross-sectional side view of the invention showing the spray nozzles emitting a stream of fluid onto, the roller brush, causing rotation and ejection of the fluid and paint residue from the roller brush.
Figure 7:
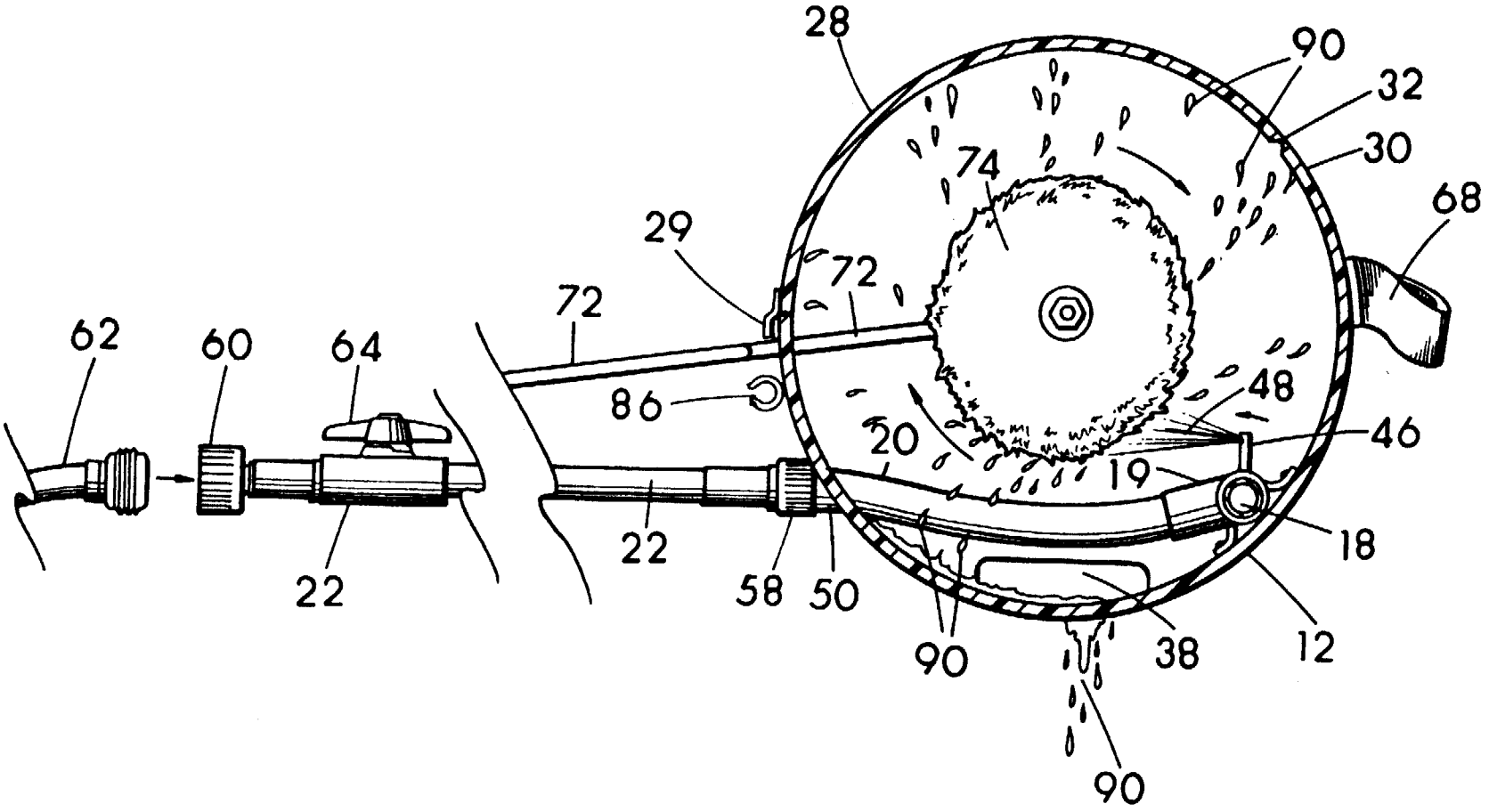
FIG. 7 is a partial cross-sectional side view of the invention illustrating the optional modified spray nozzle adjustment in use, redirecting the fluid spray onto the roller brush whereby the rotational direction of the roller brush is reversed from that shown in FIG. 6.

Housing 12 is an elongated hollow open ended transparent plastic tube having an open first end 24 and an open second end 26 with a single door 28 formed into the annular side wall 30 of housing 12. Housing 12 is preferably made using plastic extrusion manufacturing. First end 24 and second end 26 of housing 12 will hereinafter also be used to refer to the left and right ends of paint roller cleaning apparatus 10, with first end 24 generally being the left end, with second end 26 generally comprising the right end. Door 28 is created in an upward facing surface of side wall 30 by one longitudinal and two transverse connecting cuts through side wall 30 with the fourth longitudinal edge being created by a v-shaped channel forming living hinge 32, as shown in FIG. 5, 6, and 7. The V-shaped channel forming living hinge 32 is formed during the plastic extruding process of forming tubular housing 12, with the cuts forming the door 28 being performed as a secondary operation later. Door 28 is therefore inherently affixed to housing 12 by living hinge 32, comprised of a thin layer of side wall 30, which is preferably manufactured of a durable resilient plastic which will withstand repeated folding and bending.

Figure 2:
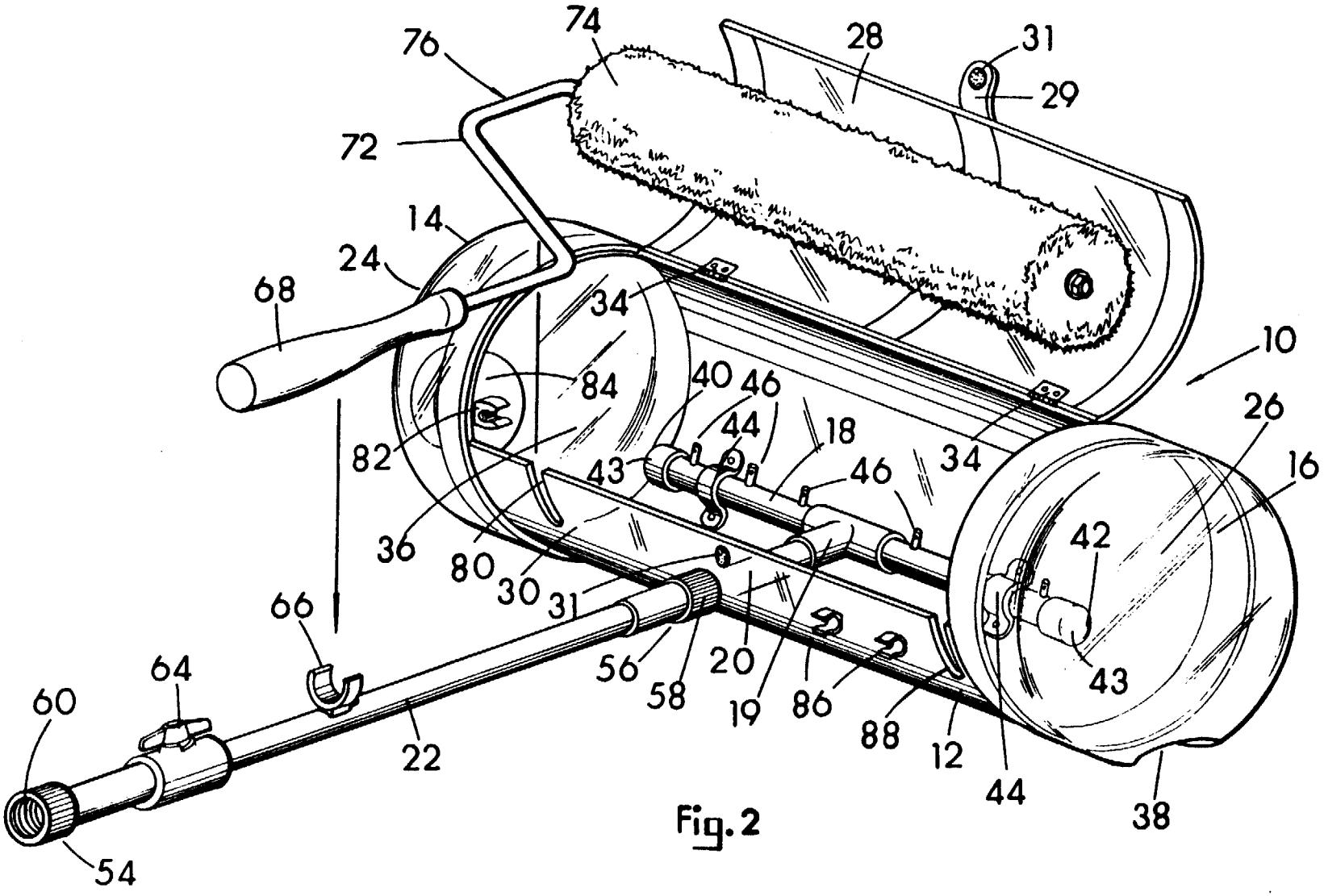
FIG. 2 is a perspective top view of one version of the invention with the angled support rod paint roller positioned ready for insertion into the housing.
Figure 3:
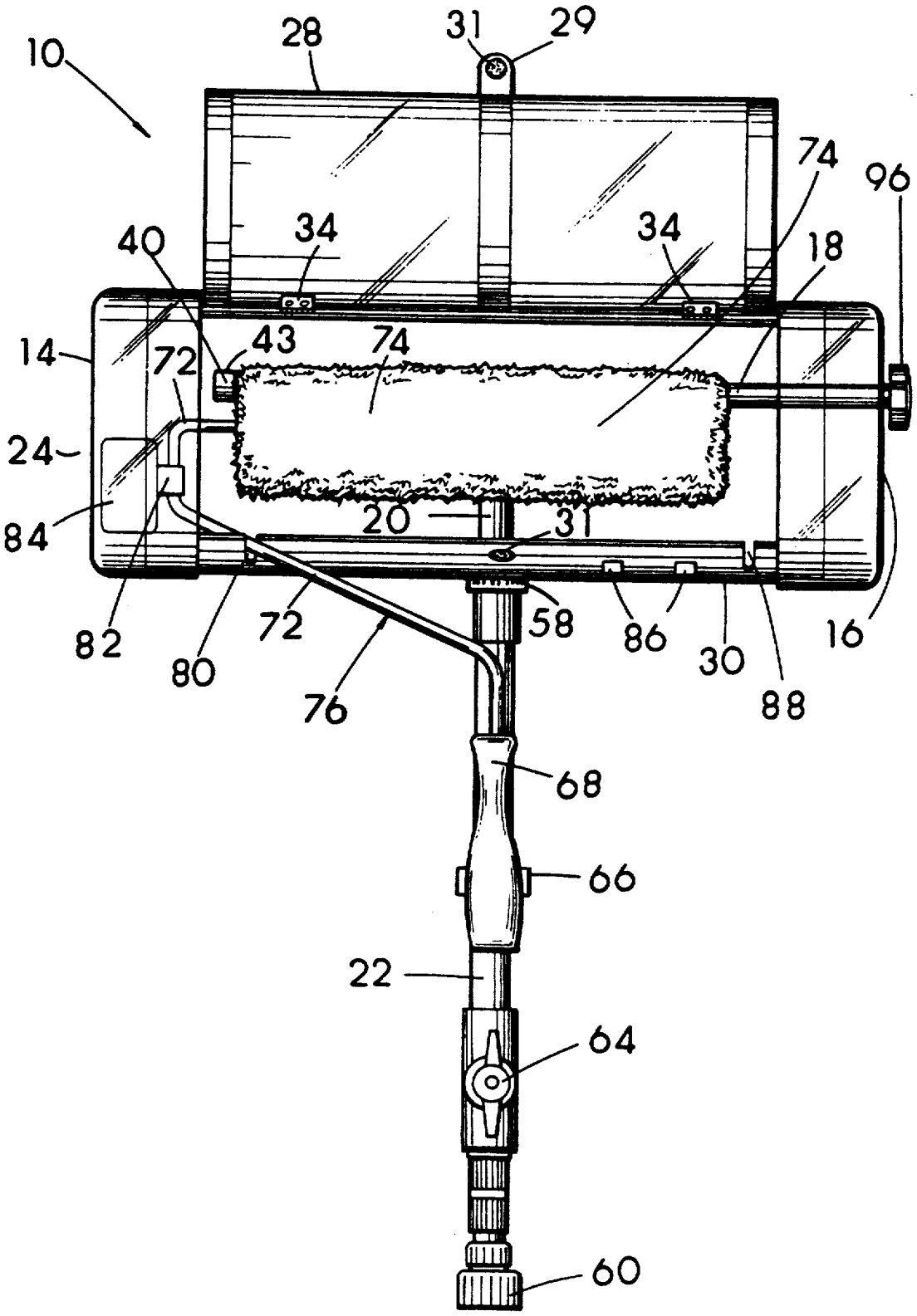
FIG. 3 is a top plan view of the version of the invention having spray angle redirecting structure. An optional adaption of the fluid distributor is shown, with the right end of the fluid distributor extending to the exterior of the housing, through the end wall, and affixed with an adjustment knob. The adjustment knob allows manual repositioning of the angle of the spray nozzles. Also shown is the angled paint roller positioned inside the housing with the housing door open.
Figure 4:
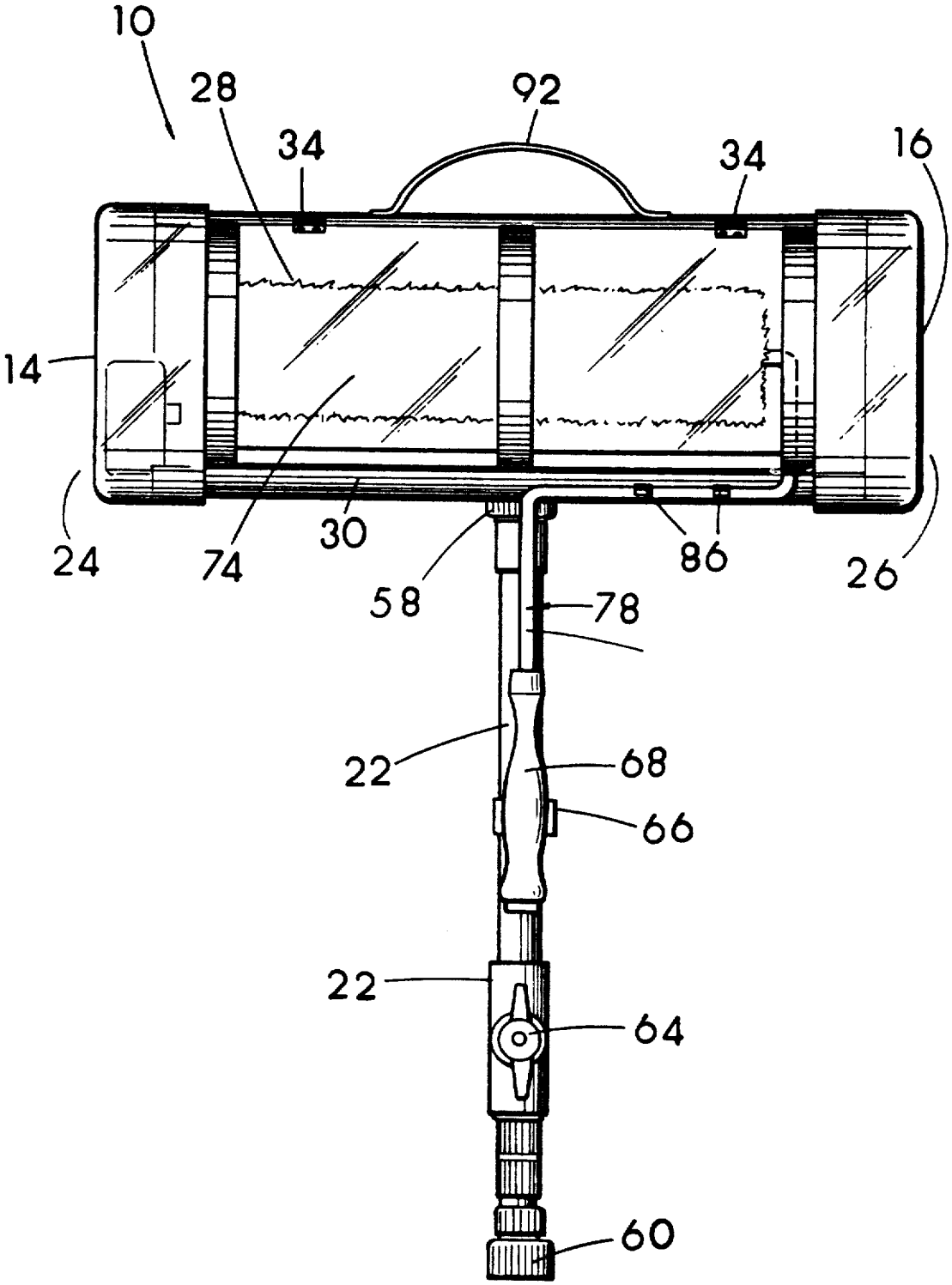
FIG. 4 is a top plan view of the invention with a straight support rod paint roller housed inside, with the door closed.

Although living hinge 32 is preferred, other attachment structures for door 28 can include bolt-on or glue-on pin hinges 34, as illustrated in FIG. 2, 3 and 4. Door 28 is also desirably transparent. Door 28 is secured in the closed position with a flexible tab, latch 29, affixed with hook and loop pile fasteners 31. One corresponding section of hook and loop fasteners 31 is affixed to the exterior of side wall 30 adjacent the open edge of door 28, and the second corresponding section of hook and loop fastener 31 is affixed to latch 29. The opening in side wall 30 of housing 12, created by door 28, is referred to as roller installation opening 36. Roller installation opening 36 extends approximately the full length of housing 12, leaving only a narrow continuous rim of side wall 30 adjacent first end 24 and second end 26. Both open first end 24 and open second end 26 of housing 12 are enclosed by first end wall 14 and second end wall 16 respectfully, which are desirably transparent plastic cup-shaped closures preferably of the same material as housing 12. Both end walls 14 and 16 are permanently affixed to housing first end 24 and housing second end 26 respectively, with adhesives or other suitable methods. Both first end wall 14 and second end wall 16 contain fluid discharge openings 38, which are oval shaped apertures created in the lower corners thereof, best shown in FIG. 5 and 6.

Housed on the interior of tubular housing 12 is fluid distributor 18 which is an elongated tubular section of rigid plastic pipe having a first end 40 and an oppositely disposed second end 42. Both first end 40 and second end 42 of fluid distributor 18 are permanently affixed with end caps 43 which enclose the open ends thereof. Fluid distributor 18 is positioned onto and parallel with the interior of side wall 30 of housing 12, generally oppositely disposed from roller installation opening 36. Fluid distributor 18 is affixed to the interior of housing 12 with two straps or brackets 44, which can be affixed with bolts, rivets, adhesives or other suitable means. Affixed to the top surface of fluid distributor 18 is a plurality of fluid spray nozzles 46. Each nozzle 46 has a small reduced diameter aperture designed to direct a high velocity stream of water or fluid 48, under pressure, from the interior of fluid distributor 18 to the interior of housing 12. The central section of fluid distributor 18 is affixed with a Tee-fitting 19 to which is connected a perpendicular projecting pipe member designated fluid feed conduit 20, best shown in FIG. 5.

Fluid feed conduit 20 is positioned perpendicular to the longitudinal annular side wall 30 of housing 12, and the distal end thereof, referred to as terminal end 50, projects through aperture 49 in side wall 30 and exits just below roller installation opening 36. Terminal end 50 projects shortly past the exterior of side wall 30 of housing 12 and is affixed with exterior threaded fitting 52, which is structured for releasable attachment to fluid feed extension conduit 22. Fluid feed extension conduit 22 is a rigid elongated tubular pipe, preferably comprised of the same material as fluid distributor 18. Fluid feed extension conduit 22 has a first end 54 and a second end 56, with second end 48 having with an internal threaded fitting 58 for releasable attachment to terminal end 50 of fluid feed conduit 20. First end 54 of fluid feed extension conduit 22 is affixed with threaded hose attachment fitting 60 sized for releasable attachment to the threaded nozzle of a supply hose 62, such as a conventional garden hose. Fluid feed extension conduit 22 is sufficiently rigid to serve as a stabilizing brace for paint roller cleaning apparatus 10, preventing the tubular housing 12 from rolling on a surface during use. The connecting three member water distribution system of fluid distributor 18, fluid feed conduit 20 and fluid feed extension conduit 22 provide conductive means for transporting water or fluid 48 from supply hose 62, or other pressurized source of fluid 48, to the reduced apertured nozzles 46. Fluid feed conduit 20, and fluid feed extension conduit 22 are provided as two connectable separate conduits primarily to allow disassembly and convenient storage, although I have considered using only one conduit in place of the two. With the use of only one conduit, the single fluid feed conduit would connect to hose 62 at one end thereof, then extend through aperture 49 to threadably engage with threads in a tee-fitting connected into fluid distributor 18.

Figure 1A:
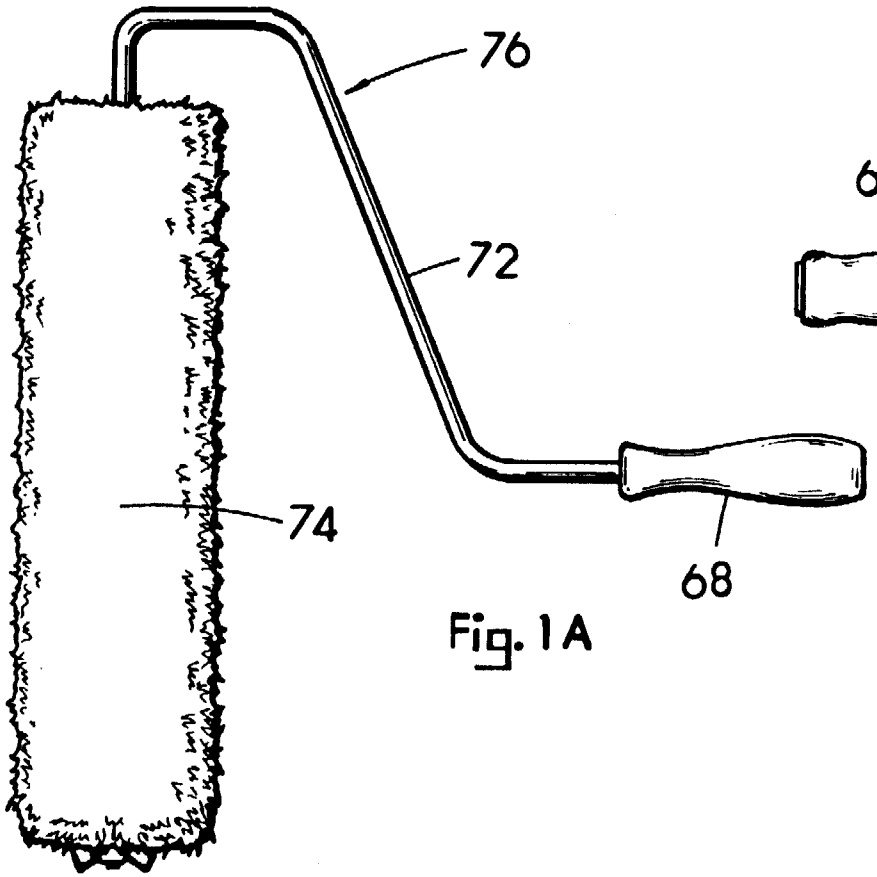
FIG. 1A is a top plan view of a paint roller having what I consider to be an angled support rod between the handle and the roller.

Adjacent first end 54 of fluid feed extension conduit 22 is one flow control valve 64. Flow control valve 64 regulates the volume of fluid 48 passing from supply hose 62 to nozzles 46. Affixed approximately midway between first end 54 and second end 56 of fluid feed extension conduit 22, is roller handle spring clip 66. Roller handle spring clip 66 is a U-shaped metal or plastic spring biased clamp used to temporarily secure handle 68 of a paint roller. There are two basic models of paint rollers commonly in use today with the major difference lying in the angle of the roller support rods 72, which connect handle 68 to roller brush 74. Roller brush 74 is an elongated cylindrical padded member structured to retain paint and to rotate freely on the end section of support rod 72, which is generally an angled metal or plastic rod. One embodiment of paint roller contains an angled support rod 72 and is referred to as first paint roller 76, while the other embodiment has a generally straight roller support rod 72 and is referred to as second paint roller 78. The embodiments of paint rollers 76 and 78 are illustrated in FIG. 1A and 1B respectively. Paint roller cleaning apparatus 10 is modified with two different forms of temporary securement structures specific for each model of paint rollers 76 and 78. Both embodiments of paint rollers 76 and 78 have one handle 68, one roller support rod 72, and one roller brush 74 each. Generally speaking, housing first end 24 is adapted for supporting first paint roller 76 while housing second end 26 is adapted for supporting second paint roller 78. For securement of first paint roller 76 into paint roller cleaning apparatus 10, roller brush 74 is first inserted into roller installation opening 36 with roller brush 74 positioned parallel to fluid distributor 18, and roller support rod 72 positioned adjacent first end wall 14. Handle 68 is inserted into handle spring clip 66, with the angled roller support rod 72 placed within first notch 80. First notch 80 is a short transverse channel formed into the edge of side wall 30 of housing 12 adjacent roller installation opening 36, adjacent first end 24 of housing 12. First notch 80 is in communication with roller installation opening 36 and is sized for insertion of a portion of support rod 72 of first paint roller 76. The upper section of support rod 72, next to roller brush 74, of first paint roller 76, is also housed inside housing 12 and is also supported by a second smaller spring biased clamp designated first paint roller spring clip 82. First paint roller spring clip 82 is affixed to the interior surface of first end wall 14 by extension plate 84, shown in FIG. 2 and 3. Extension plate 84 serves to extend first paint roller spring clip 82 into the proper position for connection to roller support rod 72. These three points of securement for first paint roller 76 maintain it in stable position during the cleaning process. Second paint roller 78 is secured to paint roller cleaning apparatus 10 with roller brush 74 positioned parallel to fluid distributor 18 and roller support rod 72 positioned adjacent second end wall 16. Support rod 72, of second paint roller 78, is supported on the exterior of housing 12 by two spring biased clamps similar to first paint roller spring clip 82, and are referred to as second paint roller spring clips 86. Second paint roller spring clips 86 are affixed to the exterior of housing 12, with bolts, adhesives or other suitable means, adjacent second end wall 16, just beneath the edge of roller installation opening 36. Support rod 72, of second paint roller 78, is inserted into second notch 88 as second paint roller 78 is inserted into the interior of housing 12. Second notch 88 is a short transverse channel in the side wall of housing 12, adjacent second end 26, which is in communication with roller installation opening 36. Both types of securement arrangements effectively secure each of the respective paint rollers in stable position during the cleaning process.

In-use, paint roller cleaning apparatus 10 is positioned with tubular housing 12 placed substantially horizontal in relation to the ground. Preferably, paint roller cleaning apparatus 10 is placed in an area where fluid and paint residue 90 are disbursed in a safe area, or collected into a container. The nozzle of supply hose 62 is connected to threaded hose-attachment fitting 60 of fluid feed extension conduit 22. Supply hose 62 would generally be connected to a water faucet of the type commonly found on residential homes, but it can also be connected to a pressurized system disbursing non-water based paint solvents, such as paint thinner, for cleaning oil based paints from roller brush 74. Either one of the paint roller embodiments is inserted into housing 12 in their respective securement clips and notches. Door 28 is then closed with latch 29. The user can either open flow control valve 64 now and then turn on the faucet to which supply hose 62 is attached and observe the cleaning process from a distance, or he can leave flow control valve 64 closed until after the faucet is opened, and then regulate flow control valve 64 to begin the cleaning process. Once fluid 48 is released into fluid distributor 18, nozzles 46 will eject a high pressure stream or jet of fluid 48 against the surface of roller brush 74. This will cause rotation of roller brush 74, initiating a centrifugal effect which ejects excess fluid and paint residue 90. Fluid and paint residue 90 will flow out fluid discharge openings 38. The user can observe the cleaning process from a distance, if desired, due to the clear plastic material from which housing 12 is manufactured. When the portion of fluid and paint residue 90 which is thrown against the interior of side wall 30 are seen to run clear, the cleaning process is finished. The paint roller can then be removed. To store or transport paint roller cleaning apparatus 10, fluid feed extension conduit 22 is removed from terminal end 50, and placed inside housing 12 for storage.

A carrying handle 92 is shown in FIG. 4 and 6 affixed to the exterior of housing 12 for easier transportation. The manufacture of housing 12 can be easily and inexpensively accomplished with common plastic extrusion methods where the V-shaped channel grooved onto the interior surface of housing 12 can be created with a die during the extrusion process. The continuous section of the tubular housing 12 being extruded can be fed onto a conveyor assembly line where various lengths of housing 12 can be automatically sectioned, the cuts for roller installation opening 36 made, and other apertures drilled and appending sections affixed. Many of the parts of this invention are also pre-manufactured items which can be bought off the shelf, saving a great deal of money on custom made parts and tooling associated therewith.

In a slight modification of the invention, a modified fluid distributor 18 is provided which allows manual repositioning of nozzles 46, which redirects the disbursement of fluid 48 against roller brush 74. This modification, shown in FIG. 3 and 5, entails extension of distributor second end 42 through an aperture 94 in second end wall 16. End cap 43 of distributor second end 42, now located on the exterior of housing 12, is permanently affixed with adjustment knob 96. Adjustment knob 96 is an annular plastic member having gripping ridges on the annular side walls, and is used to rotate fluid distributor 18 into a position whereby nozzles 46 disburse fluid 48 at an angle which enables roller brush 74 to rotate in an opposite direction. This repositioning can also affect the speed at which roller brush 74 rotates, depending upon the angle of the disbursed fluid 48. Should the disbursed fluid 48 be directed substantially perpendicular onto the surface of roller brush 74, rotation would be slow or possibly even stop altogether. Angling of the disbursed fluid 48 onto the edge of roller brush 74 causes it to rotate, with the degree of angling being generally proportional to the speed of rotation. The greater the angle the faster the rotation. Rotation of fluid distributor 18 is permitted by the secure but movable affixment of fluid distributor 18 by brackets 44. Brackets 44 secure fluid distributor 18 loose enough against side wall 30 of housing 12 to allow manual rotation with adjustment knob 96, yet also secure fluid distributor frictionally tight enough to maintain all adjusted positions of fluid distributor 18 in a stable position when adjustment knob 96 is released by the user. In order to allow rotation of fluid distributor 18 to adjust the angle of nozzles 46, fluid feed conduit 20 in this situation is desirably comprised of a flexible material such as rubber hose to allow some bending when fluid distributor 18 is repositioned, as shown in FIG. 7 where fluid feed conduit 20 is shown bent slightly downward. Other structures are anticipated to be able to rotate a roller brush in two different directions. There are universal or swivel type plumbing fittings which could be used in place of a flexible fluid feed conduit 20 adjacent fluid distributor 18 to allow partial rotation of distributor 18, but these special swivel fittings are relatively expensive. If one of these swivel fittings is used, it would replace tee-fitting 19, and eliminate the need for any flexibility in fluid feed conduit 20. By adjusting the angle of the disbursed fluid 48 against roller brush 74, more efficient cleaning is provided. When roller brush 74 rotates in one direction, the nap of the padded material tends to lay down or fold over itself in the opposite direction to which roller brush 74 is rotating. This sometimes causes small amounts of fluid and paint residue 90 to be retained under the folded nap of roller brush 74, resulting in a less than perfectly clean tool. By adjusting the angle of fluid 48 distribution, the direction and speed of rotation of roller brush 74 can be altered from clockwise to counterclockwise resulting in a cleaner roller brush 74.

Figure 8:
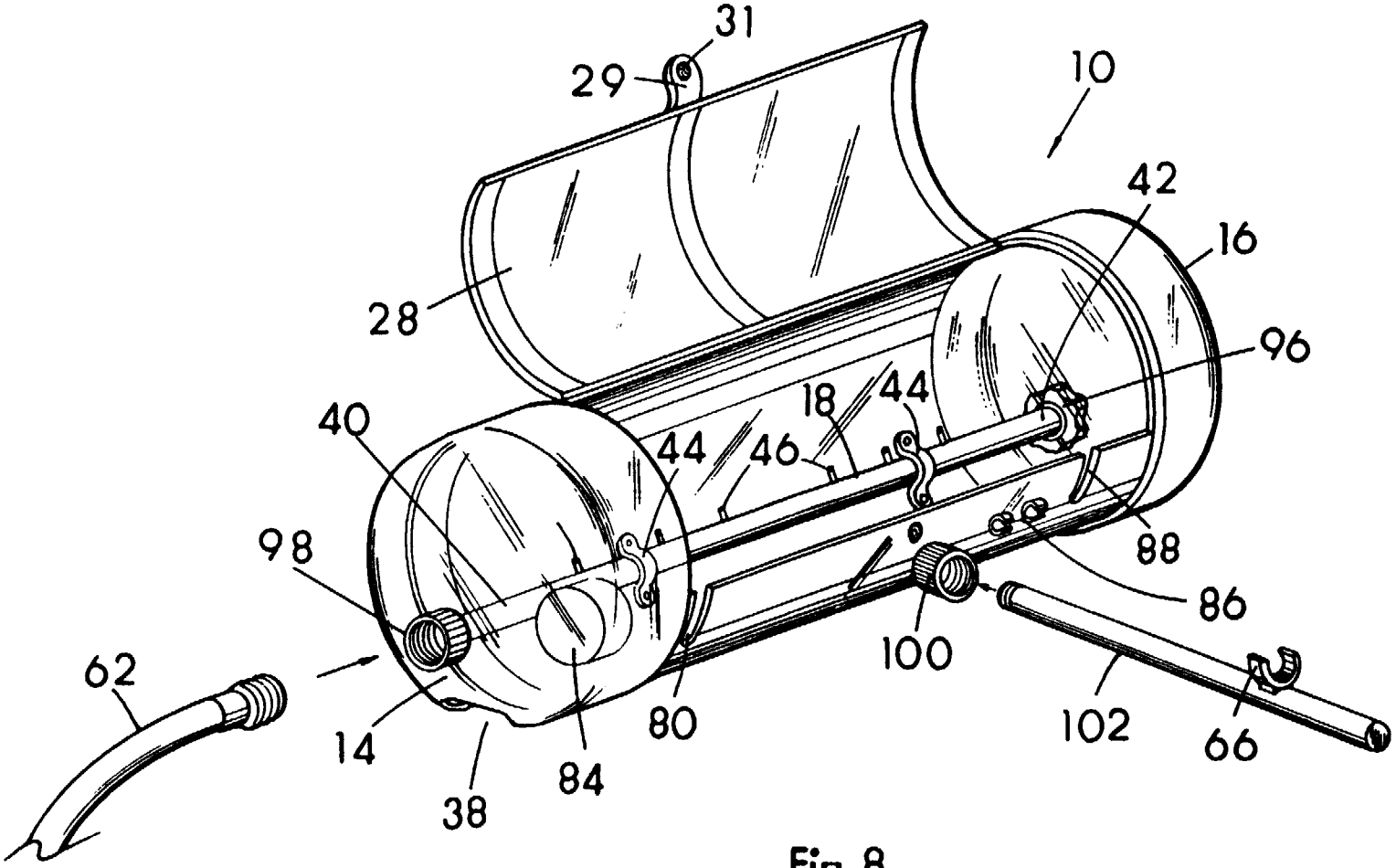
FIG. 8 is a perspective view of one version of the invention which allows connecting of a garden hose to a fitting at one end of the housing. The fluid distributor with attached spray nozzles is rotatable by way of rotating a handle shown at the opposite end of the housing from the hose.

A further slight modification of the invention is illustrated in FIG. 8, wherein both first end 40 and second end 42 of fluid distributor 18 extend outward and exit through first end wall 14 and second end wall 16 of housing 12. The portion of fluid distributor 18 projecting outward and beyond first end wall 14 is affixed with threaded hose attachment fitting 98 which can be releasably connected to the threaded end of supply hose 62 to feed water directly into distributor 18. The opposite terminal end of fluid distributor 18 is affixed with adjustment knob 96. Brackets 44 which affix fluid distributor 18 to housing 12 are fastened relatively loosely, thereby allowing fluid distributor 18 and nozzles 46 to be rotated by manual rotation of knob 96 to change the direction of the rotation of roller brush 74 during cleaning. Brackets 44 are sufficiently tight however to retain fluid distributor 18 stable during cleaning of a roller. Tee fitting 19, fluid feed conduit 20 with exterior threaded fitting 52, and aperture 49 have all been eliminated in this version. Affixed to side wall 30 of housing 12 with adhesive, where aperture 49 is located in the other versions of the invention described above, is an internally threaded fitting 100. Fluid feed extension conduit 22 and all except clip 66, of the fittings thereon have been eliminated and replaced with a short length of solid rod or pipe, designated brace 102. Brace 102 is threaded on one end thereof to allow removable attachment to threaded fitting 100. Brace 102 has roller handle spring clip 66 affixed thereto. Brace 102 serves as the support for clip 66 and further as a stabilizing brace for housing 12 during use. Brace 102 being removable, may be stored within housing 12 when not in use. This version of the invention also has the two paint roller holding positions as described above, and further is quite inexpensive to manufacture and very effective at cleaning at paint rollers.

Although I have described my invention in specific detail, I reserve the right to make alterations which fall within the scope of the appended claims. For example, although I have described fluid discharge openings 38 as apertures only, I anticipate the possible use of a discharge valve with connecting hose and or container for collecting fluid and paint residue 90. This could possibly help prevent contamination of ground water or prevent destruction of adjacent plants. Therefore, my invention is not limited to less than the scope of the appended claims.

I claim:

1. A paint roller cleaning apparatus having two separate roller holding and cleaning positions to allow cleaning of at least two types of paint rollers, one paint roller at a time, comprising:

an elongated tubular housing for use in a lengthwise horizontally disposed position on a surface, said tubular housing having a housing first end and an oppositely disposed housing second end, a first end wall generally closing said housing first end, a second end wall generally closing said housing second end, a roller installation opening in said tubular housing, said roller installation opening sized to allow installation and removal of a roller brush and at least a portion of a roller support rod supporting the roller brush into said tubular housing, an openable door hingidly attached over said roller installation opening, releasable fastening means to temporarily maintain said door closed over said roller installation opening, an elongated fluid distributor affixed within said tubular housing, said fluid distributor having means to connect to and receive a supply of pressured cleaning fluid, a plurality of nozzles on said fluid distributor, said nozzles spaced apart from one another extending generally from adjacent a first end of said fluid distributor to adjacent a second end of said fluid distributor, said nozzles further positioned to dispense and aim pressured cleaning fluid toward a roller brush when within said tubular housing to cause the roller brush to spin, an elongated rigid member removably affixed to said paint roller cleaning apparatus and extending generally perpendicular and exteriorly to said tubular housing, said rigid member having a roller handle holding means affixed thereto, said roller handle holding means sized and shaped to removably accept and tightly retain a paint roller handle, a first notch in said tubular housing adjacent said housing first end, said first notch located in communication with said roller installation opening, said first notch sized to accept a portion of a roller support rod, a first roller support rod holding means affixed to said tubular housing adjacent said housing first end, said roller handle holding means useful in conjunction with said first notch and said first roller support rod holding means to hold a paint roller in a first of said two cleaning positions, a second notch in said tubular housing adjacent said housing second end, said second notch located in communication with said roller installation opening, said second notch sized to accept a portion of a roller support rod, a second roller support rod holding means affixed to said tubular housing generally adjacent said second notch, said roller handle holding means useful in conjunction with said second notch and said second roller support rod holding means to hold a paint roller in a second of said two cleaning positions, at least one fluid discharge opening in said paint roller cleaning apparatus providing exit means for paint contaminated cleaning fluid.

2. A paint roller cleaning apparatus according to claim 1 wherein said openable door is hingidly attached to said tubular housing with a living hinge.

3. A paint roller cleaning apparatus according to claim 1 wherein at least a portion of said apparatus is transparent to allow viewing into said tubular housing.

4. A paint roller cleaning apparatus according to claim 1 wherein fluid distributor is rotatably affixed within said tubular housing allowing repositioning of said nozzles positioned to dispense and aim pressured cleaning fluid toward a roller brush when within said tubular housing, said repositioning allowing the roller brush to spin in one direction then another direction during cleaning of a roller brush.

* * * * *